US011363374B2

(12) United States Patent
Tawada

(10) Patent No.: US 11,363,374 B2
(45) Date of Patent: Jun. 14, 2022

(54) SIGNAL PROCESSING APPARATUS, METHOD OF CONTROLLING SIGNAL PROCESSING APPARATUS, AND NON-TRANSITORY COMPUTER-READABLE STORAGE MEDIUM

(71) Applicant: CANON KABUSHIKI KAISHA, Tokyo (JP)

(72) Inventor: Noriaki Tawada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/684,787

(22) Filed: Nov. 15, 2019

(65) Prior Publication Data

US 2020/0169807 A1 May 28, 2020

(30) Foreign Application Priority Data

Nov. 27, 2018 (JP) ..... JP2018-221677

(51) Int. Cl.

| | |
|---|---|
| ***H04R 3/00*** | (2006.01) |
| ***H04R 3/04*** | (2006.01) |
| ***H04R 5/027*** | (2006.01) |
| ***H04R 5/04*** | (2006.01) |

(52) U.S. Cl.

CPC ..... *H04R 3/005* (2013.01); *H04R 3/04* (2013.01); *H04R 5/027* (2013.01); *H04R 5/04* (2013.01); *H04R 2410/01* (2013.01)

(58) Field of Classification Search

CPC . H04R 3/00; H04R 3/005; H04R 3/04; H04R 5/27; H04R 5/04; H04R 2420/01; H04R 2225/61

USPC ..... 381/26, 113, 91, 92, 122, 123, 356

See application file for complete search history.

(56) References Cited

U.S. PATENT DOCUMENTS

| | | | | |
|---|---|---|---|---|
| 6,069,961 | A * | 5/2000 | Nakazawa | H04R 3/005 381/122 |
| 7,379,553 | B2 * | 5/2008 | Nakajima | G01H 3/125 381/92 |
| 8,184,827 | B2 * | 5/2012 | Yoshizawa | G01S 3/8083 381/91 |
| 9,351,071 | B2 * | 5/2016 | Kechichian | H04R 3/005 |
| 9,357,308 | B2 * | 5/2016 | Freeman | H04S 7/303 |
| 9,538,288 | B2 | 1/2017 | Tawada | |
| 9,554,203 | B1 * | 1/2017 | Pavlidi | H04R 1/08 |
| 9,615,173 | B2 * | 4/2017 | Sako | G06F 3/167 |

(Continued)

FOREIGN PATENT DOCUMENTS

JP H07336790 A 12/1995

*Primary Examiner* — Xu Mei

(74) *Attorney, Agent, or Firm* — Carter, DeLuca & Farrell LLP

(57) ABSTRACT

A signal processing apparatus that processes a plurality of audio signals obtained by acquiring a sound in a target area by performing sound acquisition by a plurality of sound acquisition units, comprising: a specification unit configured to specify a position of a sound source in the target area and positions and directivities of the plurality of sound acquisition units; and a selection unit configured to select, among the plurality of audio signals based on the sound acquisition by the plurality of sound acquisition units, an audio signal to be played back based on a degree of misalignment of the directivity of each of the plurality of sound acquisition units with respect to the specified position of the sound source.

12 Claims, 8 Drawing Sheets

(56) References Cited

U.S. PATENT DOCUMENTS

| | | | | |
|---|---|---|---|---|
| 9,967,660 | B2 | 5/2018 | Tawada | |
| 9,998,822 | B2 | 6/2018 | Tawada | |
| 2007/0019815 | A1* | 1/2007 | Asada | H04R 29/00 381/58 |
| 2009/0180633 | A1* | 7/2009 | Ishibashi | H04R 1/403 381/59 |
| 2009/0285409 | A1* | 11/2009 | Yoshizawa | G01S 3/8083 381/92 |
| 2010/0008515 | A1* | 1/2010 | Fulton | H04R 3/005 381/92 |
| 2013/0083942 | A1* | 4/2013 | hgren et al. | G01S 3/8083 381/92 |
| 2015/0312690 | A1* | 10/2015 | Yuyama | H04R 29/002 381/59 |
| 2016/0192068 | A1* | 6/2016 | Ng | H04R 1/406 381/92 |
| 2017/0280238 | A1* | 9/2017 | Noda | G06K 9/00248 |
| 2017/0374453 | A1* | 12/2017 | Tawada | H04S 1/007 |

* cited by examiner

SIGNAL PROCESSING APPARATUS, METHOD OF CONTROLLING SIGNAL PROCESSING APPARATUS, AND NON-TRANSITORY COMPUTER-READABLE STORAGE MEDIUM

BACKGROUND OF THE INVENTION

Field of the Invention

The present invention relates to a signal processing apparatus, a method of controlling the signal processing apparatus, and a non-transitory computer-readable storage medium, and particularly, a technique for selecting an audio signal to be used from a plurality of audio signals.

Description of the Related Art

In a sound acquisition target area such as a field in a stadium, if a target sound such as a kicking sound in a soccer game which has been generated in the sound acquisition target area is to be acquired, the sound is acquired by using a plurality of directional microphones that are arranged to surround the sound acquisition target area and face toward the inside of the sound acquisition target area.

Japanese Patent Laid-Open No. 7-336790 discloses that, in a conference system or the like in which a microphone is arranged in front of each speaker, the sound from the microphone of a speaker with the earliest utterance timing (or with the loudest voice in a case in which the timing is of the same degree) will be selected.

However, the technique of the related art is problematic in that a sound that is suitable from the point of view of sound quality may not be selected when an audio signal to be used for playback is to be selected from a plurality of audio signals based on sound acquisition performed by a plurality of microphones.

The present invention provides, in consideration of the problem described above, a technique for selecting an audio signal that is suitable from the point of view of sound quality when an audio signal to be used for playback is to be selected from a plurality of audio signals based on sound acquisition performed by a plurality of microphones.

SUMMARY OF THE INVENTION

According to one aspect of the present invention, there is provided a signal processing apparatus that processes a plurality of audio signals obtained by acquiring a sound in a target area by performing sound acquisition by a plurality of sound acquisition units, comprising: a specification unit configured to specify a position of a sound source in the target area and positions and directivities of the plurality of sound acquisition units; and a selection unit configured to select, among the plurality of audio signals based on the sound acquisition by the plurality of sound acquisition units, an audio signal to be played back based on a degree of misalignment of the directivity of each of the plurality of sound acquisition units with respect to the specified position of the sound source.

Further features of the present invention will be apparent from the following description of exemplary embodiments with reference to the attached drawings.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Arrangement

Figure 1:
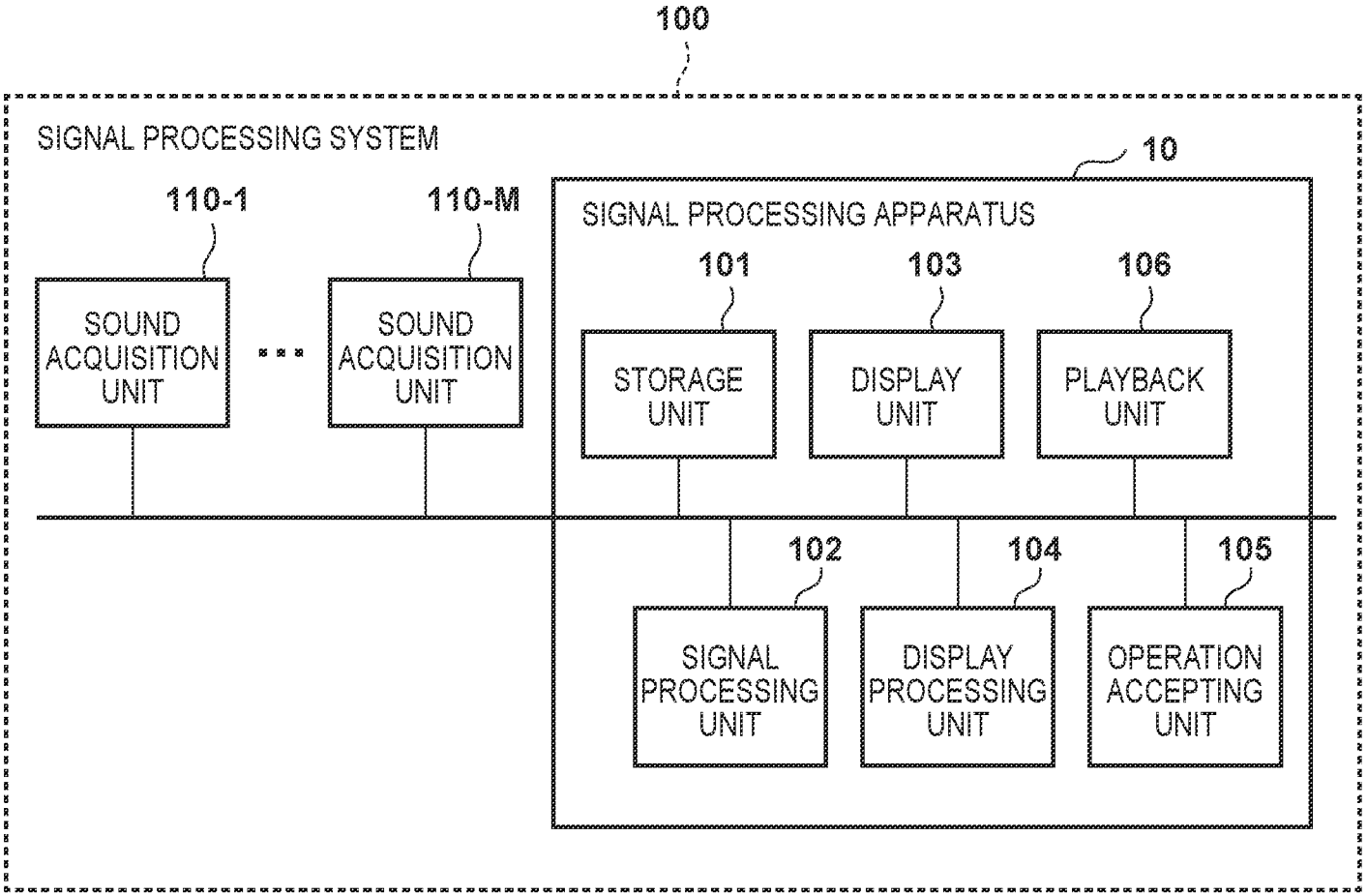
FIG. 1 is a block diagram showing an example of the arrangement of a signal processing system according to the first embodiment.

FIG. 1 is a block diagram of a signal processing system 100 according to the first embodiment of the present invention. The signal processing system 100 includes a signal processing apparatus 10 and M sound acquisition units 110-1 to 110-M arranged surrounding a sound acquisition target area. Reference symbol M denotes the number of sound acquisition units.

The sound acquisition units 110-1 to 110-M are formed by directional microphones or a microphone array, include interfaces for sound acquisition, and sequentially record, in a storage unit 101, audio signals 120-1 to 120-A (not shown) that have been acquired. Reference symbol A denotes the number (channel number) of audio signals. Since two or more audio signals will correspond to one sound acquisition unit in a case in which the sound acquisition units are formed by a microphone array and a plurality of directions of directivity are simultaneously formed to simultaneously acquire audio signals that have a plurality of directions of directivity, the number A of audio signals the number M of sound acquisition units.

The signal processing apparatus 10 includes the storage unit 101, a signal processing unit 102, a display unit 103, a display processing unit 104, an operation accepting unit 105, and a playback unit 106. The operation of the signal processing apparatus 10 is controlled by a control unit, such as a CPU or the like (not shown), reading out and executing a program stored in the storage unit 101.

The storage unit 101 stores the audio signals 120-1 to 120-A and various kinds of data and programs.

The signal processing unit 102 performs processing related to audio signals. The processing related to audio signals include, for example, processing to select an audio signal that is to be played back among the plurality of audio signals based on the sound acquisition by the plurality of sound acquisition units 110-1 to 110-M. The display unit 103 is typically a display and is assumed to be formed by a touch panel in this embodiment. The display processing unit 104 generates the display contents related to audio signal selection and displays the generated contents on the display unit 103. The operation accepting unit 105 detects and accepts each operation input made by a user on the display unit 103 formed by a touch panel. The playback unit 106 is formed by a headphone or a loudspeaker, includes an interface (that performs D/A conversion or amplification) related to playback, and plays back the generated playback signal. Note that although an example in which the signal processing apparatus 10 includes the display unit 103 has been described in this embodiment, the display unit 103 may be present outside the signal processing apparatus 10. In such a case, the processing contents of the display processing unit 104 will be output to and displayed on the external display unit 103.

Processing

The procedure of processing performed by the signal processing apparatus according to the first embodiment will be described hereinafter with reference to the flowchart of FIG. 2.

In step S201, the signal processing unit 102 initializes selection information of audio signals for each time frame that has a predetermined length of time to, for example, −1 which is a negative value.

Since the processes of step S202 and subsequent steps are processes for each time frame, the processes will be performed in a time frame loop.

In step S202, the signal processing unit 102 refers to selection information S of the current time frame to determine whether the selection information has already been set ($S \neq -1$). If the selection information has been already set, the process advances to step S208. On the other hand, if the selection information has not been set ($S=-1$), the process will advance to step S203.

Since the process of step S203 is a process performed for each audio signal, the process will be performed in an audio signal loop.

In step S203, the signal processing unit 102 performs, for an audio signal (one of audio signals 120-1 to 120-A) set as the target of the current audio signal loop, target sound detection processing on the audio signal of the current time frame to determine whether a target sound has been detected. The target sound according to this embodiment is a sound emitted from a predetermined sound source (a player, a ball, a goal or the like). If the target sound is detected, the process advances to step S205. On the other hand, if the audio signal loop ends without the target sound being detected in all of the audio signals of the current time frame, the process advances to step S204.

As the target sound detection operation, a known processing operation such as a determining operation in which detection of the target sound is determined if the signal level exceeds a threshold, a determination operation in which a sudden target sound is determined from a waveform peak, or the like can be performed. Note that the target sound may be detected by using not only the current time frame but also an audio signal of a past time frame.

In step S204, the signal processing unit 102 sets the selection information S=0 (no selection) to the audio signal of the current time frame, and the process advances to step S208.

Since the processes of steps S205 and S206 are processes performed for each audio signal, the processes are performed in an audio signal loop.

In step S205, for each audio signal set as the target of the current audio signal loop, the signal processing unit 102 analyzes the audio signals of a time block (time segment) corresponding to the length of a plurality of time frames from the current time frame, and obtains the result as analysis data.

Figure 3:
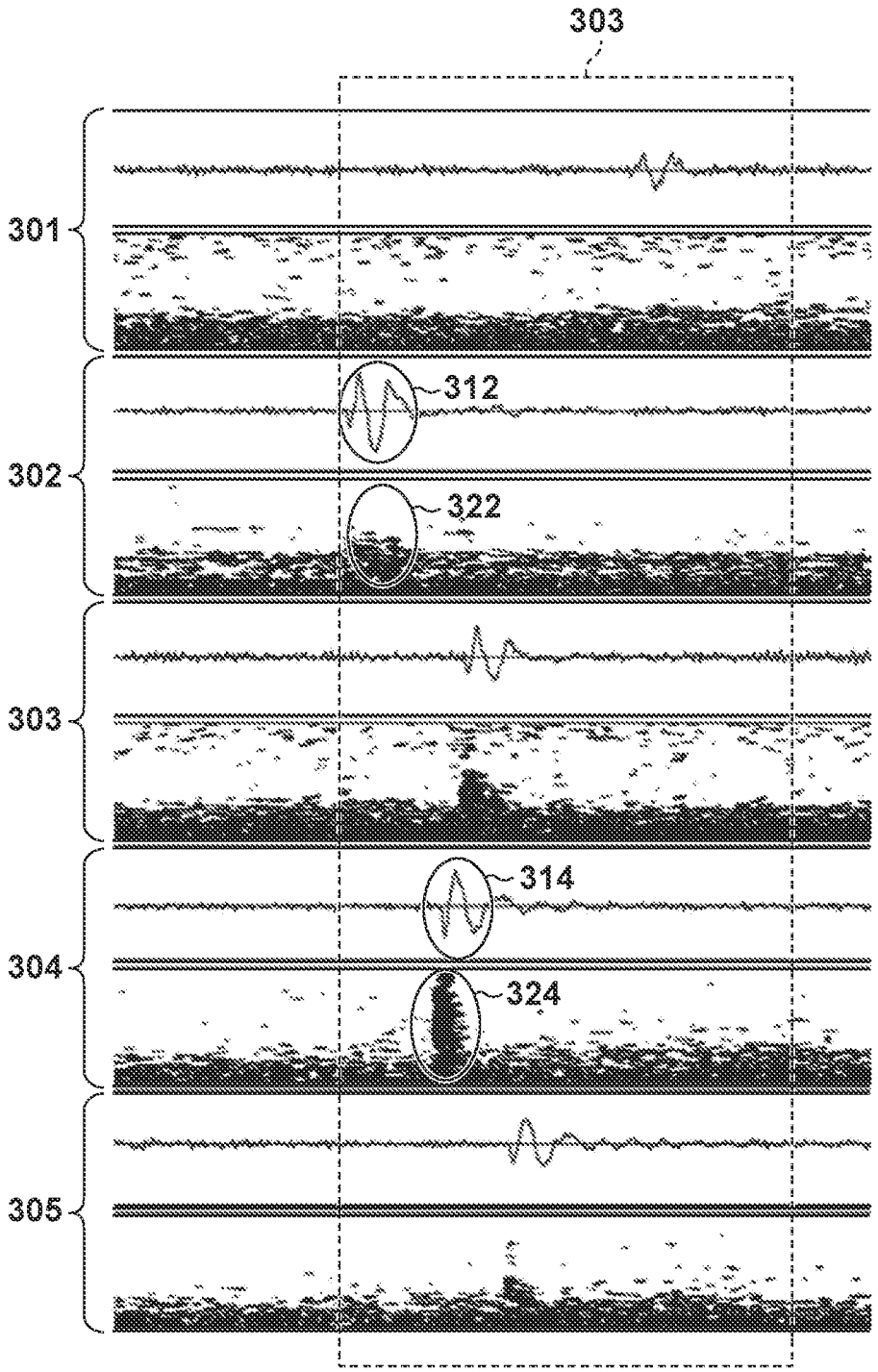
FIG. 3 is an explanatory view of audio signal selection according to the first embodiment.

FIG. 3 is an explanatory view of the audio signal selection according to this embodiment. An example in which a target sound, such as a ball kicking sound, generated in a sound acquisition target area, such as field in a stadium, is acquired by using a plurality of sound acquisition units arranged to surround the sound acquisition target area and face toward the inside of the sound acquisition target area will be described.

In a case in which a target sound is to be acquired by using a plurality of sound acquisition units, for example, a given kicking sound may be input with time differences to a plurality of audio signals 301 to 305 which have been acquired by a plurality of sound acquisition units as shown in FIG. 3. The upper and lower two-stage display corresponding to each of the audio signals 301 to 305 in FIG. 3 shows a time waveform on the upper stage and a high-range (5 to 20 kHz) spectrogram on the lower stage.

For example, as is obvious from a time waveform 312 of the target sound, the audio signal 302 is the signal in which the target sound arrives earliest. This means that the sound acquisition unit which corresponds to the audio signal 302 is positioned closest to the target sound generation position. However, since a frequency characteristic 322 of the target sound does not extend to a sufficiently high frequency range (the loss of high frequency components), this signal is not necessarily suitable from the point of view of sound quality. This is because even if the position of the target sound is close to the sound acquisition unit corresponding to the audio signal 302, the directivity (the axis direction of the directional microphone) of this sound acquisition unit deviates from the target sound.

In addition, as is obvious from a time waveform 314 of the target sound, the audio signal 304 should be selected from the point of view of sound quality because a frequency characteristic 324 of the target sound extends to a sufficiently high frequency range (without the loss of the high frequency components) even though the target sound arrival order of this signal is second among the audio signals 301 to 305. This is because the directivity of the sound acquisition unit corresponding to the audio signal 304 is closer to the target sound even if the target sound position is a somewhat far from this sound acquisition unit.

In the case of the example shown in FIG. 3, the left end of a time block 330 corresponds to the current time frame. In this case, assume that the time block length is of a length that can include the given target sound input with the time differences and is, for example, 150 msec. The data analyzed in step S205 is, more specifically, the target sound detection result (detected by processing similar to that in step S203) for each time frame in the time block 330, the frequency characteristic (spectrogram) for each time frame obtained by Fourier transform, or the like.

In step S206, the signal processing unit 102 uses the analyzed data of the time block obtained in step S205 to calculate the value of an evaluation function f which is used to determine the selection priority of each target audio signal of the current audio signal loop. In this case, the evaluation function f is set so that the smaller the evaluation function value the higher the selection priority will be. Note that if the target sound has not been detected in the audio signal of the time block, the evaluation function value will be set to a sufficiently large value so this audio signal will not be selected in the subsequent step.

In a case in which the target sound has been detected in the audio signal of the time block, the evaluation function f will be set based on equation (1) so that an audio signal in which the frequency characteristic of the target sound extends to a sufficiently high frequency range (without the loss of high frequency components) will be selected.

$$f=(\text{the high-frequency attenuation amount of a target sound}) \quad (1)$$

Figure 4:
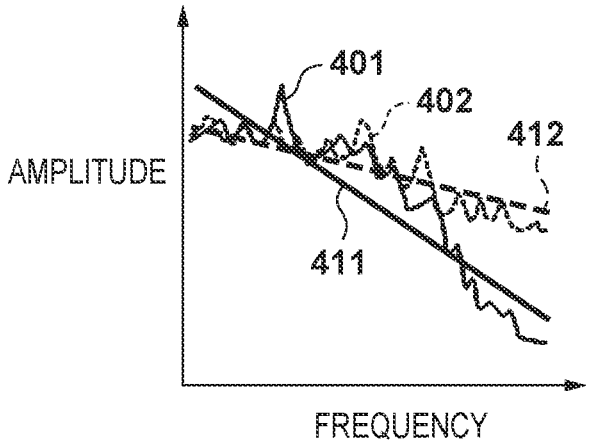
FIG. 4 is an explanatory view of frequency characteristics according to the first embodiment.

As a more specific calculation method of the term related to (the high-frequency attenuation amount of a target sound) of equation (1), for example, an approximation characteristic such as an approximate line (which slopes downward toward the right with respect to the frequency axis) is calculated for each frequency characteristic (the analyzed data of step S205) belonging to the time frame in which the target sound has been detected. A high selection priority is set to the audio signal by determining that the high-frequency attenuation amount of the target sound is small when the slope of the approximate line is moderate (the absolute value of the slope is small). FIG. 4 is a view showing a schematic example of the frequency characteristics of the time frame in which the target sound has been detected and the approximate lines of the frequency characteristics. In this case, since the slope of an approximate straight line 412 of a frequency characteristic 402 indicated by dotted lines is more moderate (the absolute value of the slope is smaller) than the slope of an approximate straight line 411 of a frequency characteristic 401 indicating by a solid line, the audio signal corresponding to the frequency characteristic 402 is selected as the audio signal to be played back.

Note that the present invention is not limited to the calculation method described above, and another calculation method may be used. For example, it may be determined that each frequency characteristic (analyzed data of step S205) of the time frame in which the target sound has been detected has a wide frequency band when there is a large number of frequency components of a predetermined level or more. The selection priority of the audio signal is accordingly increased by determining that the high-frequency attenuation amount of the target sound is small when the frequency band is wide (when there is a large number of frequency components of a predetermined level or more).

Alternatively, the average level of the high-frequency range of a predetermined frequency (for example, 5 kHz) or more is calculated for each frequency characteristic (the analyzed data of step S205) of the time frame in which the target sound has been detected. The selection priority of the audio signal is increased by assuming that the high-frequency attenuation amount of the target sound will be small when the average level is high.

Note that in a case in which the target sound has been detected over a plurality of time frames, a frequency characteristic that has been obtained by performing averaging over these time frames may be used.

Since the audio signal 304 whose frequency characteristic of the target sound extends sufficiently to a high frequency range (without the loss of high frequency components) is selected in the example of FIG. 3 by determining the selection priority of the audio signal based on the concept described above, the audio signal is suitable from the point of view of sound quality.

Note that the term related to (the high-frequency attenuation amount of the target sound) of equation (1) is a term that focuses on, as a concept of sound quality, a point of view concerning whether the high frequency components of a target sound have been lost. However, even if the frequency characteristic of the target sound extends to a sufficiently high frequency range, if a lot of noise (cheering sounds and the like from outside the sound acquisition target area) has been superimposed (on the middle and low frequency ranges) and the signal-to-noise ratio (S/N ratio) of the target sound becomes small, this audio signal may not be the most suitable audio signal from the point of view of sound quality. Hence, as the concept of sound quality, the point of view of the signal-to-noise ratio (S/N ratio) of the target sound is added to the point of view concerning the loss of the high frequency components of the target sound so that the evaluation function f may be determined based on, for example, a concept such as $$f=(\text{the high-frequency attenuation amount of the target sound})-\beta\times(\text{the signal-to-noise ratio of the target sound}) \quad (2)$$

where $\beta\geq 0$ is a weighting coefficient of the term related to (the signal-to-noise ratio of the target sound), and a minus sign has been added to the term so that the selection priority will increase as the evaluation function value decreases in accordance with the increase in the signal-to-noise ratio of the target sound. In this manner, the selection priority will be set so that an audio signal whose frequency characteristic attenuation amount of a predetermined frequency or more is small and whose signal-to-noise ratio is high will be selected.

As a more specific calculation method of the term related to (the signal-to-noise ratio of the target sound) of equation (2), for example, the timing at which the target sound is detected in the time block of the time frame will be considered. The selection priority of the audio signal will be set high by considering that the signal-to-noise ratio of the target sound will be high when the (arrival) timing of the target sound is early, that is, when the distance between the (generation) position of the target sound and the position of the sound acquisition unit corresponding to the audio signal is small.

Alternatively, an approximate signal-to-noise ratio of the target noise may be calculated from the signal levels of the time frame in which the target sound has been detected or from the signal levels (corresponding to the noise) of a time frame other than this, and the selection priority of the audio signal may be set high when the signal-to-noise ratio of the target sound is high.

Note that in relation to the fact that the signal-to-noise ratio of the target noise is to be considered, it may be arranged so that an audio signal will be selected in the following manner instead of applying equation (2). For example, it may be arranged so that an audio signal (the audio signal 304 in the example of FIG. 3) whose frequency characteristic of the target sound extends to a sufficiently high frequency range (without the loss of the high frequency components) will be selected when the amount of noise (cheering sounds) is small, that is, when the signal-to-noise ratio of the target sound is high. On the other hand, it may be arranged so that an audio signal (the audio signal 302 in the example of FIG. 3) with the earliest target sound timing will be selected when the amount of noise is large, that is, the signal-to-noise ratio of the target sound is low so as to select an audio signal which has a high signal-to-noise ratio. As a result, it is possible to select an audio signal that has a good sound quality.

In step S207, the signal processing unit 102 refers to the evaluation function value of the selection priority of each of the audio signals 120-1 to 120-A calculated in step S206. Then, the selection information of the plurality of time frames of a time block including the current time frame is set based on an identification number a (one of 1 to A) of the audio signal that has the smallest evaluation function value. At this time, the identification number a may be set to the selection information of only the time frame in which the target sound has been detected in the audio signal 120-*a* of the time block, and 0 (no selection) may be set to the selection information of other time frames.

In step S208, the signal processing unit 102 selects, based on selection information S (one of 0 to A) of the current time frame set in step S204 or step S207, the audio signal which includes the target sound from the audio signals 120-1 to 120-A (no selection is made when S=0). Subsequently, this selected audio signal is used to generate a playback signal which is to be played back by the playback unit 106. For example, the playback signal will be generated by executing processing to mix the selected audio signal with another audio signal acquired by a sound acquisition unit (not shown) other than the sound acquisition units 110-1 to 110-M. In step S209, the playback unit 106 plays back the playback signal generated in step S208.

Note that the display processing unit 104 may generate display contents (graph) related to the selection as that shown in FIG. 3, and the display unit 103 may display the generated display contents. In this case, it may be arranged so that the selection priority will be displayed beside each audio signal (for example, in descending order of priority from 1 to 5) or so that the selected audio signal with the highest priority will be highlighted and displayed.

Note that it may be set so that the weighting coefficient β of equation (2) can be adjusted in accordance with an operation input by the user via the operation accepting unit 105. That is, in terms of the concept of sound quality, it may be set so that the weight placed on the point of view concerning the loss of high-frequency components of the target sound and the weight placed on the point of view concerning the signal-to-noise ratio of the target sound can be adjusted. Note that known noise suppression processing, such as spectrum subtraction, a Wiener filter or the like, for suppressing noise other than the target sound may be performed before the target sound is detected in step S203.

As described above, according to this embodiment, an audio signal is selected from a plurality of audio signals based on the frequency characteristics of the audio signals in the time segment including the target sound. For example, an audio signal which includes a target sound whose frequency characteristic extends to a sufficiently high frequency range (without the loss of high frequency components) will be selected based on the high-frequency attenuation amount of the target sound. As a result, it is possible to select an audio signal that has a good sound quality. Note that although it has been assumed that a single audio signal will be selected from a plurality of audio signals based on sound acquisition by a plurality of microphones and that the selected audio signal will be used for playback in this embodiment, the present invention is not limited to this. For example, the signal processing apparatus 10 may select two or more audio signals that include many high-frequency components, and a playback signal may be generated by combining these selected audio signals in consideration of delays.

Second Embodiment

Arrangement

Figure 5:
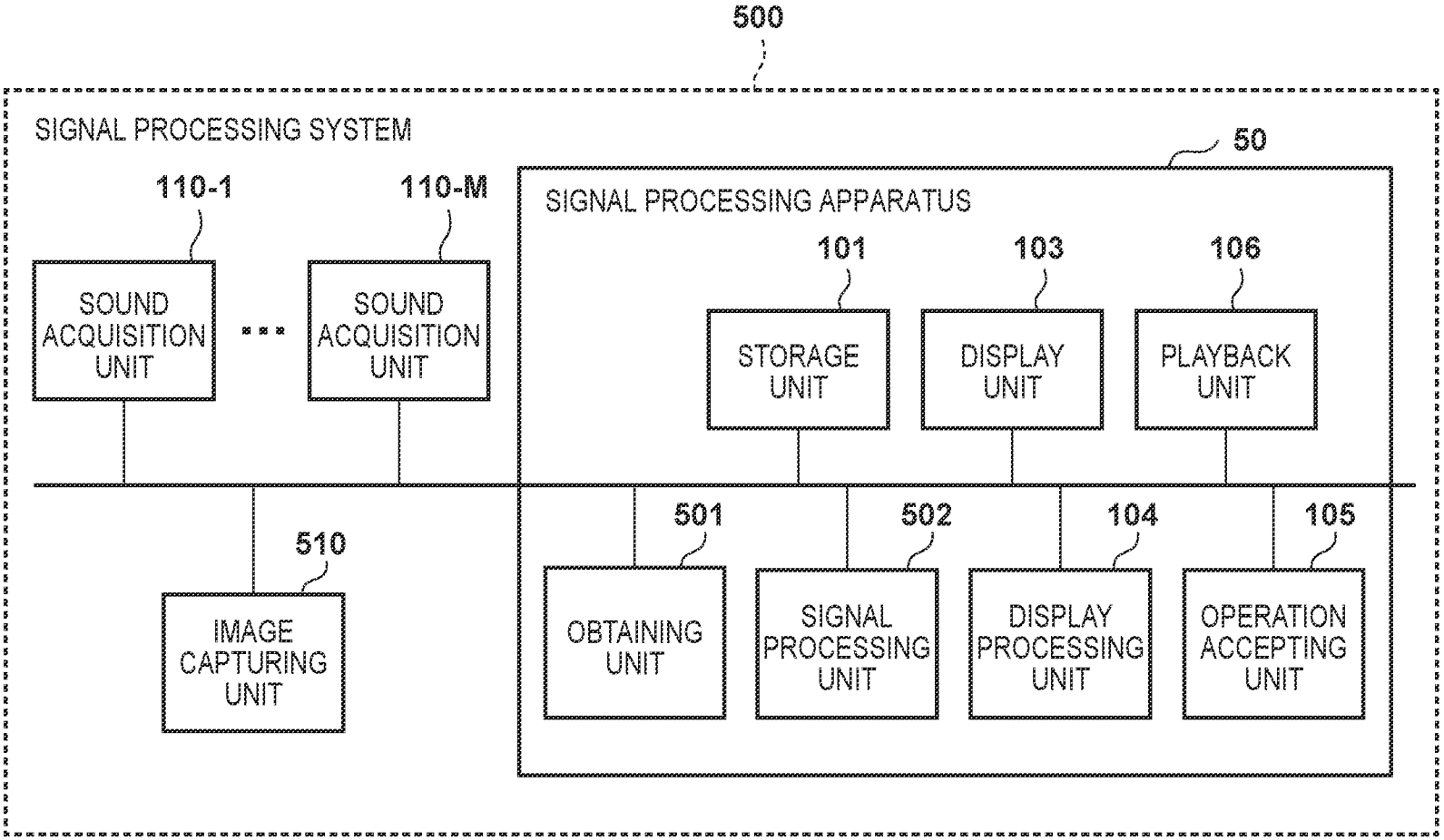
FIG. 5 is a block diagram showing an example of the arrangement of a signal processing system according to the second embodiment.

FIG. 5 is a block diagram of a signal processing system 500 according to the second embodiment of the present invention. Points different from those described about the signal processing system 100 of FIG. 1 according to the first embodiment will be mainly described hereinafter.

The signal processing system 500 includes a signal processing apparatus 50, sound acquisition units 110-1 to 110-M, and an image capturing unit 510. In addition, although the signal processing apparatus 50 differs from a signal processing apparatus 10 according to the first embodiment in that an obtaining unit 501 and a signal processing unit 502 are included instead of a signal processing unit 102, other components are similar to those of the first embodiment.

The obtaining unit 501 obtains the information of the position where the target sound has been generated. The obtaining unit 501 also obtains, from a storage unit 101, the information of the (installation) position, the directivity, and the directivity characteristic of each of the sound acquisition units 110-1 to 110-M that acquire the plurality of audio signals.

The signal processing unit 502 performs processing related to image signals and audio signals. The image capturing unit 510 is formed by a camera that captures a sound acquisition target area, includes an interface related to image capturing, and sequentially stores each captured image signal in the storage unit 101.

Processing

Figure 6:
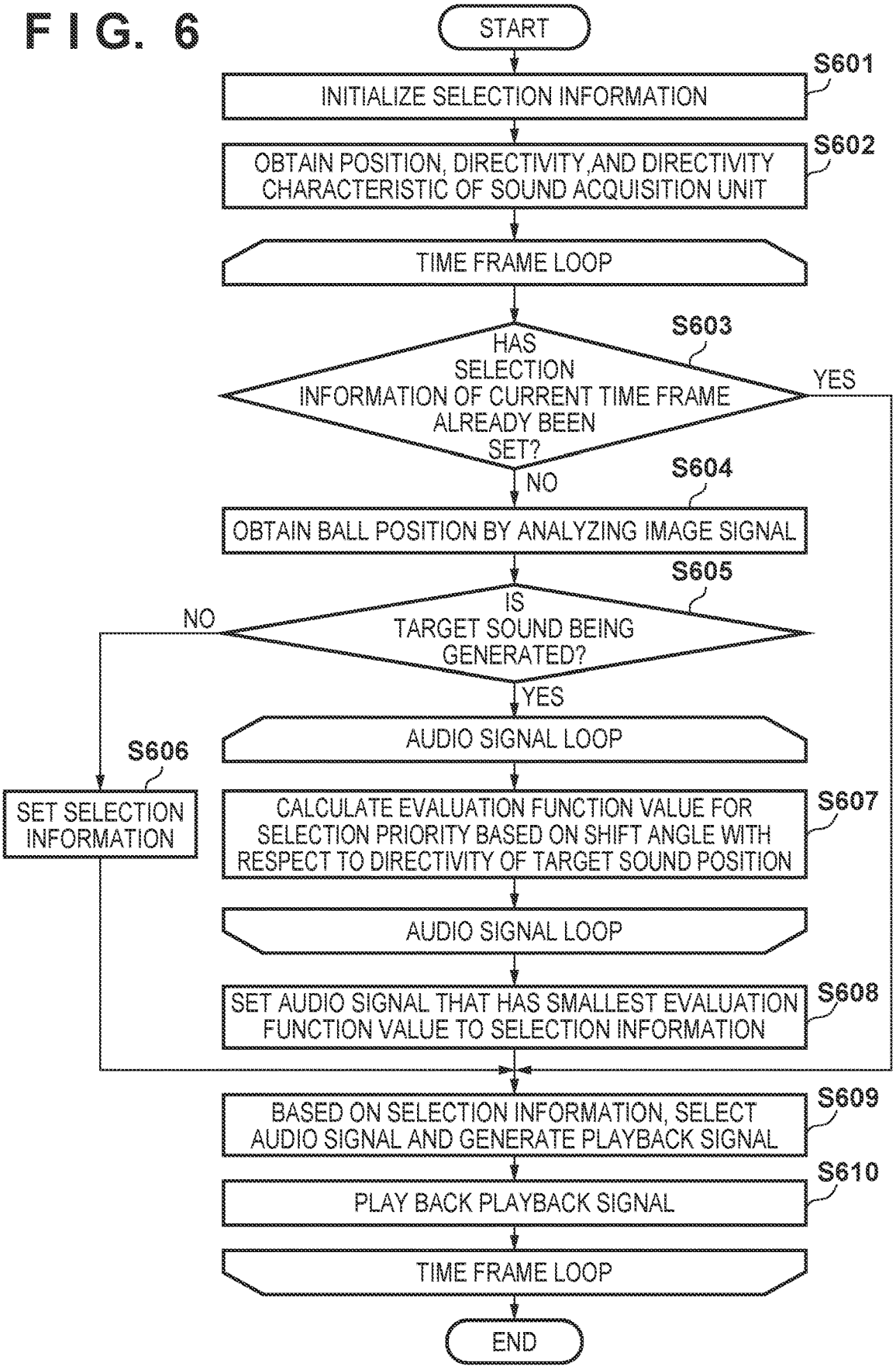
FIG. 6 is a flowchart showing the procedure of processing according to the second embodiment.

The procedure of processing performed by the signal processing apparatus according to the second embodiment will be described hereinafter with reference to the flowchart of FIG. 6.

Figure 2:
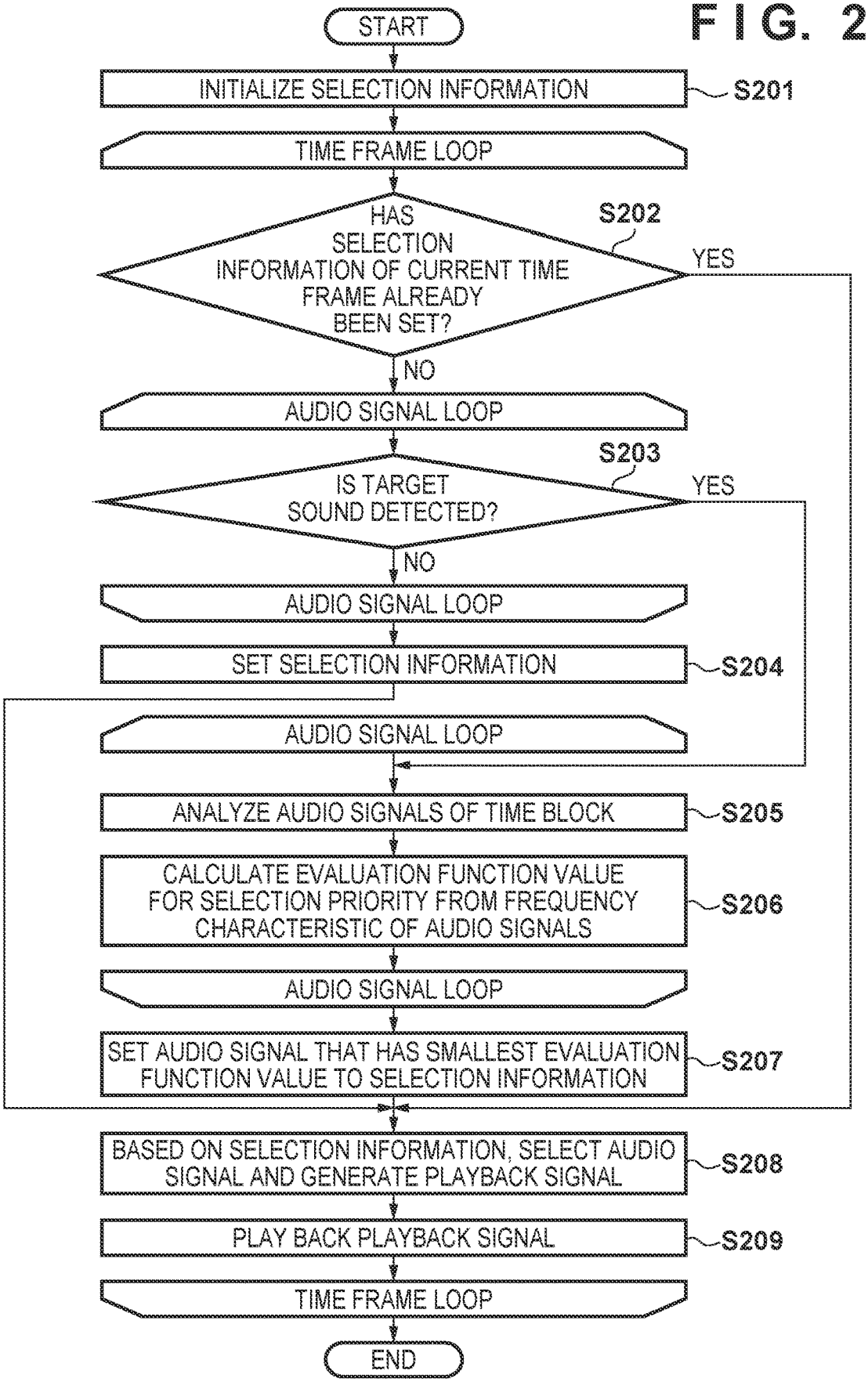
FIG. 2 is a flowchart showing the procedure of processing according to the first embodiment.

A description of the process of step S601 will be omitted since it is a process similar to that in step S201 of FIG. 2 described the first embodiment.

In step S602, the obtaining unit 501 obtains the information of the (installation) position, the directivity, and the directivity characteristic of each of the sound acquisition units 110-1 to 110-M which are already held in the storage unit 101. In this case, assume that the positions and the directivities are described in a global coordinate system. Typically, for example, the origin of the global coordinate system is set at the center of a sound acquisition target area, the x-axis and the y-axis are set to be parallel to the respective sides of the sound acquisition target area, and the z-axis is set in a vertical direction perpendicular to these axes. Additionally, a directivity characteristic is a frequency characteristic for a degree of misalignment (shift angle of 0°, 30°, 60°, or the like) with respect to the directivity in the manner schematically shown in FIG. 8. The details of FIG. 8 will be described later.

Note that the position, the directivity, and the microphone type (which can be associated with the directivity characteristic) of each of the sound acquisition units 110-1 to 110-M can be obtained by detecting each sound acquisition unit by applying image recognition processing on each image signal including the images of the sound acquisition units 110-1 to 110-M which surround the sound acquisition target area. In this case, image recognition processing that has been trained in advance by using images of various kinds of sound acquisition units may be used. Note that it may be set so that the position and the directivity of each of the sound acquisition units 110-1 to 110-M will be obtained by providing a GPS and an orientation sensor to each sound acquisition unit. Note that it may also be set so that the position, the directivity, and the microphone type of each of the sound acquisition units 110-1 to 110-M may be input by the user via an operation accepting unit 105.

Since the processes of step S603 and its subsequent steps are processes performed for each time frame, the processes will be performed in a time frame loop.

In step S603, the signal processing unit 502 refers to selection information S of the current time frame and determines whether the selection information S has already been set (S≠−1). If the selection information S has already been set (S≠−1), the process advances to step S609. On the other hand, if the selection information S has not been set (S=−1), the process advances to step S604.

In step S604, the obtaining unit 501 detects the ball and each player which are to be a target sound generation source (sound source) by applying the learned image recognition processing on the image signal of the current time block captured by the image capturing unit 510. The obtaining unit 501 obtains the position of the target sound generation source in the global coordinate system by executing projective transformation or the like. Note that a GPS may be attached to the ball and each player to obtain the position.

In step S605, the signal processing unit 502 uses the information of the ball position and the like obtained in step S604 to determine whether the target sound is being generated. If it is determined that the target sound is being generated, the process advances to step S607. On the other hand, if it is determined that the target sound is not being generated, the process advances to step S606. In this case, the generation of the target sound may be determined based on the contact between the ball and a player (the distance between the ball and the player is within a threshold), the contact between the ball and the ground (z coordinate of the ball≈0), the change in the speed of the ball, motion vector inversion, or the like. In addition, the position information of not only the current time frame but also the past time frame may be applied.

In step S606, the signal processing unit 502 sets the selection information S=0 (no selection) to the selection information of the audio signal of the current time frame, and the process advances to step S609.

Since the process of step S607 is a process performed for each audio signal, the process will be performed in an audio signal loop.

In step S607, the signal processing unit 502 uses the information of the sound acquisition units 110-1 to 110-M obtained in step S602 and the position information of the target sound (ball) obtained in step S604 to calculate the value of an evaluation function f to determine the selection priority of an audio signal (one of audio signals 120-1 to 120-A) set as a target in the current audio signal loop.

First, a case in which the evaluation function of equation (1) focusing, as the concept of sound quality, on the point of view concerning whether the loss of high-frequency components of the target sound has occurred will be considered. In this case, as a more specific calculation method of the term related to (the high-frequency attenuation amount of the target sound) of equation (1) according to the second embodiment, the shift angle with respect to the directivity of the sound acquisition unit is calculated for the position of the target sound obtained by the sound acquisition unit corresponding of the audio signal. The selection priority of the audio signal is increased by determining that the high-frequency attenuation amount of the target sound will be small when the shift angle is small.

Figure 7:
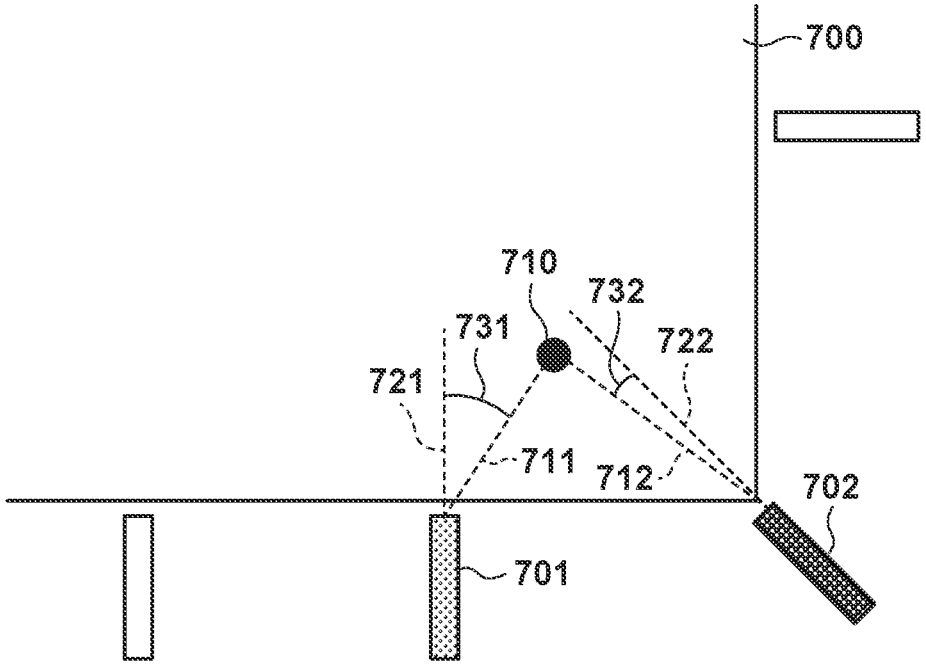
FIG. 7 is an explanatory view of audio signal selection according to the second embodiment.

In the example of a sound acquisition target area 700 shown in FIG. 7, a shift angle 732 between a directivity direction 722 and a direction 712 of a target sound position 710 viewed from a sound acquisition unit 702 is smaller than a shift angle 731 between a directivity direction 721 and a direction 711 of the target sound position 710 viewed from a sound acquisition unit 701. Hence, the audio signal acquired by the sound acquisition unit 702 is more suitable in the point of view of sound quality because the selection priority of this audio signal, which can be considered to include a target sound having a frequency characteristic that extends to a high frequency range (without the loss of high-frequency components), will be higher than the selection priority of the audio signal acquired by the sound acquisition unit 701.

Note that although the processing described above assumes that (the directivity characteristic ascribed to) the microphone type of each sound acquisition unit will be the same, the (high-frequency) attenuation amount of the frequency characteristic of the sound acquisition unit for each shift angle with respect to the directivity may be calculated when the information of the directivity characteristic of the sound acquisition unit can be used. In such a case, a high selection priority will be set to the audio signal by determining that the high-frequency attenuation amount of the target sound will be small when the attenuation amount of the frequency characteristic of the sound acquisition unit is small. In the example shown in FIG. 8, in terms of the shift angle with respect to the directivity of the position of the target sound, although a 30° shift angle of a sound acquisition unit 802 is smaller than a 60° shift angle of a sound acquisition unit 801, the audio signal acquired by the sound acquisition unit 801 is selected as the audio signal to be played back since an attenuation amount 811 of the frequency characteristic corresponding to the shift angle is smaller than an attenuation amount 812.

A case in which the evaluation function of equation (2) obtained by adding the point of view concerning the signal-to-noise ratio of the target noise to the point of view concerning the loss of high-frequency components of the target range will be considered next as the concept of sound quality. In this case, as a more specific calculation method of the term related to (the signal-to-noise ratio of the target noise) of equation (2) according to the second embodiment, the distance between the position of the target sound and the position of the sound acquisition unit corresponding to the audio signal will be calculated. The selection priority of the audio signal will be set high by considering that the signal-to-noise ratio of the target sound will be high when the distance is short. That is, the audio signal to be played back can be selected based on both the degree of misalignment in the directivity of each sound acquisition unit with respect to the position of the sound source and the distance between each sound acquisition unit and the position of the sound source.

In addition, the selection priority of the audio signal may be set high by considering that the signal-to-noise ratio of the target sound will be high when the directivity of the sound acquisition unit is sharp (the directional gain is large).

Note that in order to consider the signal-to-noise ratio of the target sound, it may be arranged so that the audio signal will be selected in the following manner instead of using equation (2). In the example shown in FIG. 7, it may be arranged so that the audio signal acquired by the sound acquisition unit 702, which has the smallest shift angle with respect to the directivity of the position of the target sound, will be selected when the signal-to-noise ratio of the target sound is high. On the other hand, it may be arranged so that the audio signal acquired by the sound acquisition unit 701, which has the shortest distance to the position of the target sound, will be selected so that the audio signal with the high signal-to-noise ratio will be selected when the signal-to-noise ratio of the target sound is low.

Figure 8:
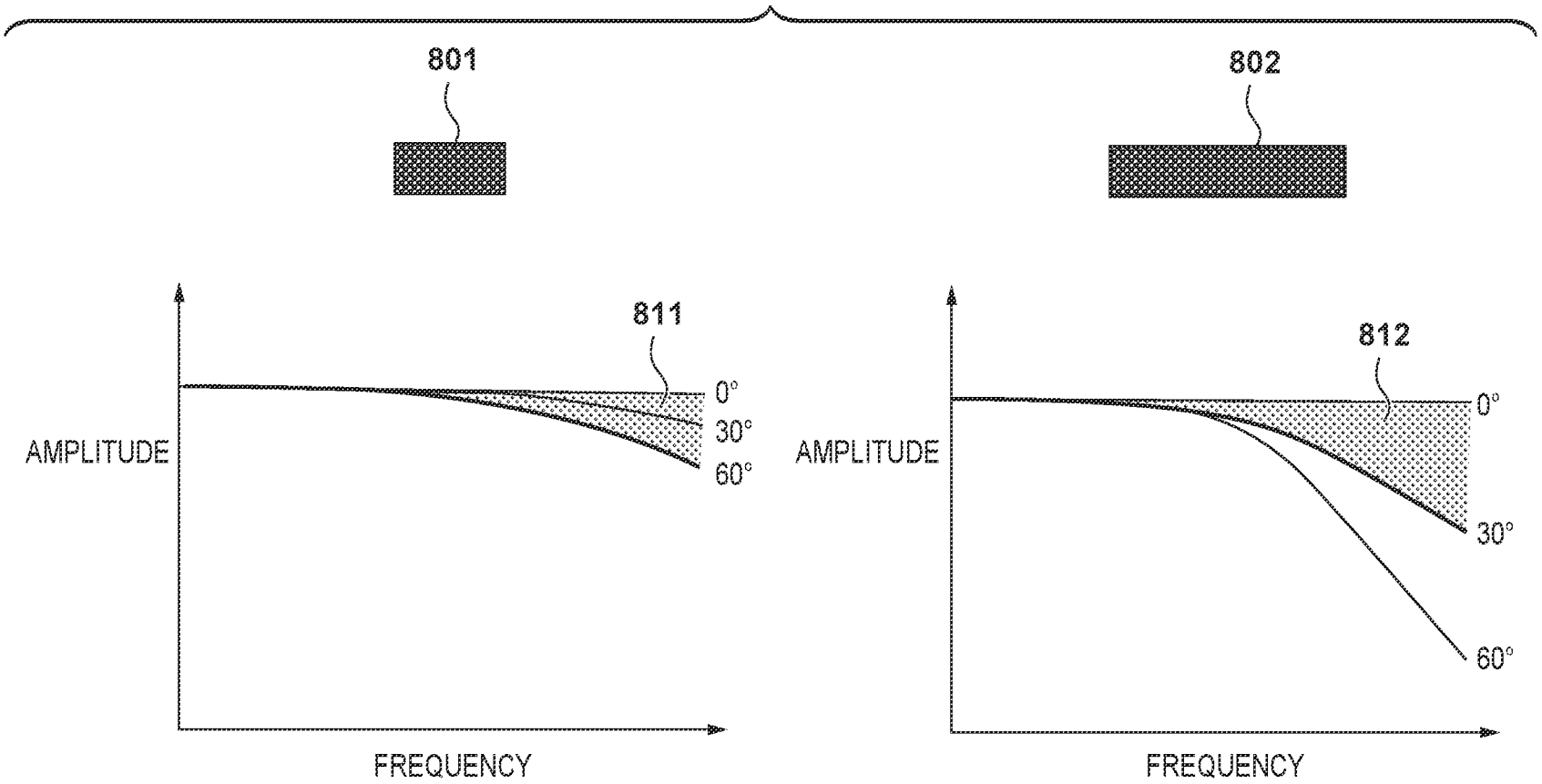
FIG. 8 is an explanatory view of directivity characteristics according to the second embodiment.

Also, in the example shown in FIG. 8, it may be arranged so that the audio signal acquired by the sound acquisition unit 801, in which the attenuation amount of the frequency characteristic of the sound acquisition unit corresponding to the shift angle of with respect to the directivity is small, will be selected when the signal-to-noise ratio of the target sound is high. On the other hand, it may be arranged so that the audio signal acquired by the sound acquisition unit 802, which has a sharp directivity (has a large directional gain), will be selected when the signal-to-noise ratio of the target sound is low.

In step S608, the signal processing unit 502 refers to the evaluation function value of the selection priority of each of the audio signals 120-1 to 120-A calculated in step S607. Then, the selection information of the plurality of time frames of a time block including the current time frame is set based on an identification number a (one of 1 to A) of the audio signal that has the smallest evaluation function value.

The processes performed in the subsequent steps S609 and S610 are the same as the processes described in steps S208 and S209 of FIG. 2 according to the first embodiment, thus a description will be omitted.

Note that a lookup table predefining the selection information of the audio signal for each position of the target sound may be prepared by calculating the evaluation function value for determining the selection priority of each audio signal for each position of the target sound. In this case, it may be set so that the audio signal will be selected based on the lookup table.

Note that in a case in which an azimuth component of the x-y plane is dominant, such as in the case of soccer, in relation to the shift angle with respect to the directivity of the position of the target sound, the position of the target sound and the position and the directivity of each sound acquisition unit may be considered in a two-dimensional manner (x, y) in this embodiment. On the other hand, in a case in which the shift angle will be larger than the elevation angle component, such as in the case of volley ball, the embodiment may be considered in a three-dimensional manner (x, y, z).

Note that it may be arranged so that a display processing unit 104 will generate display contents (a bird's-eye view or a graph) such as those shown in FIGS. 7 and 8 and display the generated contents on a display unit 103. In this case, the selection priority of each acquired audio signal may be displayed in the vicinity of the corresponding sound acquisition unit or the darkness of the fill color of the sound acquisition unit may be increased as the priority of the audio signal corresponding to the sound acquisition unit is set higher as shown in FIG. 7. In the example of FIG. 7, it is possible to easily visually recognize that the sound acquisition unit 702 has the highest priority and the sound acquisition unit 701 has the second highest priority.

Note that the audio signal may be selected by combining the first and second embodiments in an appropriate manner. For example, the term related to (the high-frequency attenuation amount of the target sound) of equation (1) may be calculated by obtaining a weighted sum of the slope (first embodiment) of the approximation characteristic (approximate line) of the frequency characteristic calculated from an audio signal and a shift angle (second embodiment) with respect to the directivity of the position of the target sound calculated from the image signal.

As described above, according to this embodiment, an audio signal is selected from a plurality of audio signals based on a misalignment in the directivity of each sound acquisition unit with respect to the target sound generation position. For example, a shift angle with respect to the directivity of the sound acquisition unit corresponding to each audio signal may be calculated in relation to the position of the target sound viewed from the sound acquisition unit, and a high selection priority may be set to the audio signal when the shift angle is small. As a result, it is possible to select an audio signal that has a good sound quality. Note that although it has been assumed that a single audio signal will be selected from a plurality of audio signals based on sound acquisition by a plurality of microphones and that the selected audio signal will be used for playback in this embodiment, the present invention is not limited to this. For example, the signal processing apparatus 50 may select two or more audio signals based on sound acquisition by two or more microphones having small shifts in directivity with respect to the sound source, and a playback signal may be generated by combining these selected audio signals in consideration of delays.

According to the present invention, an audio signal which is suitable in the point of view of sound quality can be selected when an audio signal to be used for playback is to be selected from a plurality of audio signals based on sound acquisition by a plurality of microphones.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-221677, filed on Nov. 27, 2018, which is hereby incorporated by reference wherein in its entirety.

What is claimed is:

1. A signal processing apparatus, comprising:

one or more memories storing instructions; and one or more processors executing the instructions to:

specify a position of a sound source and positions and directivities of a plurality of sound acquisition units;

obtain, for each of the plurality of sound acquisition units, a difference between i) a first direction determined by the specified directivity of each of the plurality of sound acquisition units and ii) a second direction determined by the specified position of the sound source and the specified position of each of the plurality of sound acquisition units; and select, among a plurality of sound signals that are based on sound acquisition by the plurality of sound acquisition units, a sound signal that is based on a sound acquisition unit of which the difference is smaller than that of another sound acquisition unit, wherein a gain in the direction determined by the specified directivity of a sound acquisition unit included in the plurality of sound acquisition units is larger than a gain in other direction.

2. The apparatus according to claim 1, wherein the sound signal is selected further based on a distance between the specified position of each of the plurality of sound acquisition units and the specified position of the sound source.

3. The apparatus according to claim 1, wherein the sound signal is selected further based on a frequency characteristic related to acquisition of sound in a position shifted from the direction determined by the specified directivity of each sound acquisition unit.

4. The apparatus according to claim 1, wherein the sound signal is selected further based on a frequency characteristic of each of the plurality of sound signals in a time segment in which a target sound generated by the sound source is acquired.

5. The apparatus according to claim 1, wherein the one or more processors further execute the instructions to:

cause a display unit to display contents related to the selection of the sound signal.

6. The apparatus according to claim 1, wherein the one or more processors further execute the instructions to:

perform processing to suppress, in the selected sound signal, noise other than a target sound generated by the sound source.

7. The apparatus according to claim 1, wherein the one or more processors further execute the instructions to generate a playback signal based on the selected sound signal.

8. The apparatus according to claim 7, wherein, in a case where two sound signal are selected, the playback signal is generated based on the two sound signal.

9. The apparatus according to claim 1, wherein the sound signal is selected further based on sharpness of the specified directivity of each of the plurality of sound acquisition units.

10. The apparatus according to claim 1, wherein the position of the sound source is specified based on learned image recognition processing.

11. A method of controlling a signal processing apparatus, the method comprising:

specifying a position of a sound source and positions and directivities of a plurality of sound acquisition units;

obtaining, for each of the plurality of sound acquisition units, a difference between i) a first direction determined by the specified directivity of each of the plurality of sound acquisition units and ii) a second direction determined by the specified position of the sound source and the specified position of each of the plurality of sound acquisition units; and selecting, among a plurality of sound signals that are based on sound acquisition by the plurality of sound acquisition units, a sound signal that is based on a sound acquisition unit of which the difference is smaller than that of another sound acquisition unit, wherein a gain in the direction determined by the specified directivity of a sound acquisition unit included in the plurality of sound acquisition units is larger than a gain in other direction.

12. A non-transitory computer-readable storage medium storing a computer program for causing a computer to execute a method of controlling a signal processing apparatus, wherein the method comprises specifying a position of a sound source and positions and directivities of a plurality of sound acquisition units; and obtaining, for each of the plurality of sound acquisition units, a differences between i) a first direction determined by the specified directivity of each of the plurality of sound acquisition units and ii) a second direction determined by the specified position of the sound source and the specified position of each of the plurality of sound acquisition units; and selecting, among a plurality of sound signals that are based on sound acquisition by the plurality of sound acquisition units, a sound signal that is based on a sound acquisition unit of which the difference is smaller than that of another sound acquisition unit, wherein a gain in the direction determined by the specified directivity of a sound acquisition unit included in the plurality of sound acquisition units is larger than a gain in other direction.

* * * * *